US005117162A

United States Patent [19]

Dunham et al.

[11] Patent Number: 5,117,162

[45] Date of Patent: May 26, 1992

[54] OPTICAL GRADE TRANSFER COOLANT FOR PROJECTION TELEVISION RECEIVERS

[75] Inventors: Donald D. Dunham, Sevierville; Sherilyn M. Coburn, Knoxville, both of Tenn.

[73] Assignee: North American Philips Corporation, New York, N.Y.

[21] Appl. No.: 630,684

[22] Filed: Dec. 20, 1990

[51] Int. Cl.[5] ..... H01J 7/24; H01J 7/26

[52] U.S. Cl. ..... 313/36; 313/44; 313/46; 313/477 R

[58] Field of Search ..... 313/35, 36, 44, 46, 313/477 R

[56] References Cited

U.S. PATENT DOCUMENTS 4,725,755 2/1988 Hasegawa ..... 313/477 R
4,775,817 10/1988 Duwaer et al. ..... 313/36
4,780,640 10/1988 Hasegawa ..... 313/36

OTHER PUBLICATIONS

Exxon Product Brochure Lubetext DG-1 P; pp. 1-7, 9-12; Sep. 21, 1984.

*Primary Examiner*—Donald J. Yusko
*Assistant Examiner*—Nimeshkumar D. Patel
*Attorney, Agent, or Firm*—Edward W. Goodman

[57] ABSTRACT

A method and apparatus for cooling a cathode ray tube in a projection television receiver including a lens assembly for focusing images formed by the cathode ray tube. A cooling chamber is arranged in front of the cathode ray tube and behind the lens assembly in thermal contact with the face of the cathode ray tube through which the images are projected. This cooling chamber is then filled with an optically clear substantially waterless liquid consisting of an isoparaffinic solvent which is distributed under the trademark ISOPAR V.

4 Claims, 1 Drawing Sheet

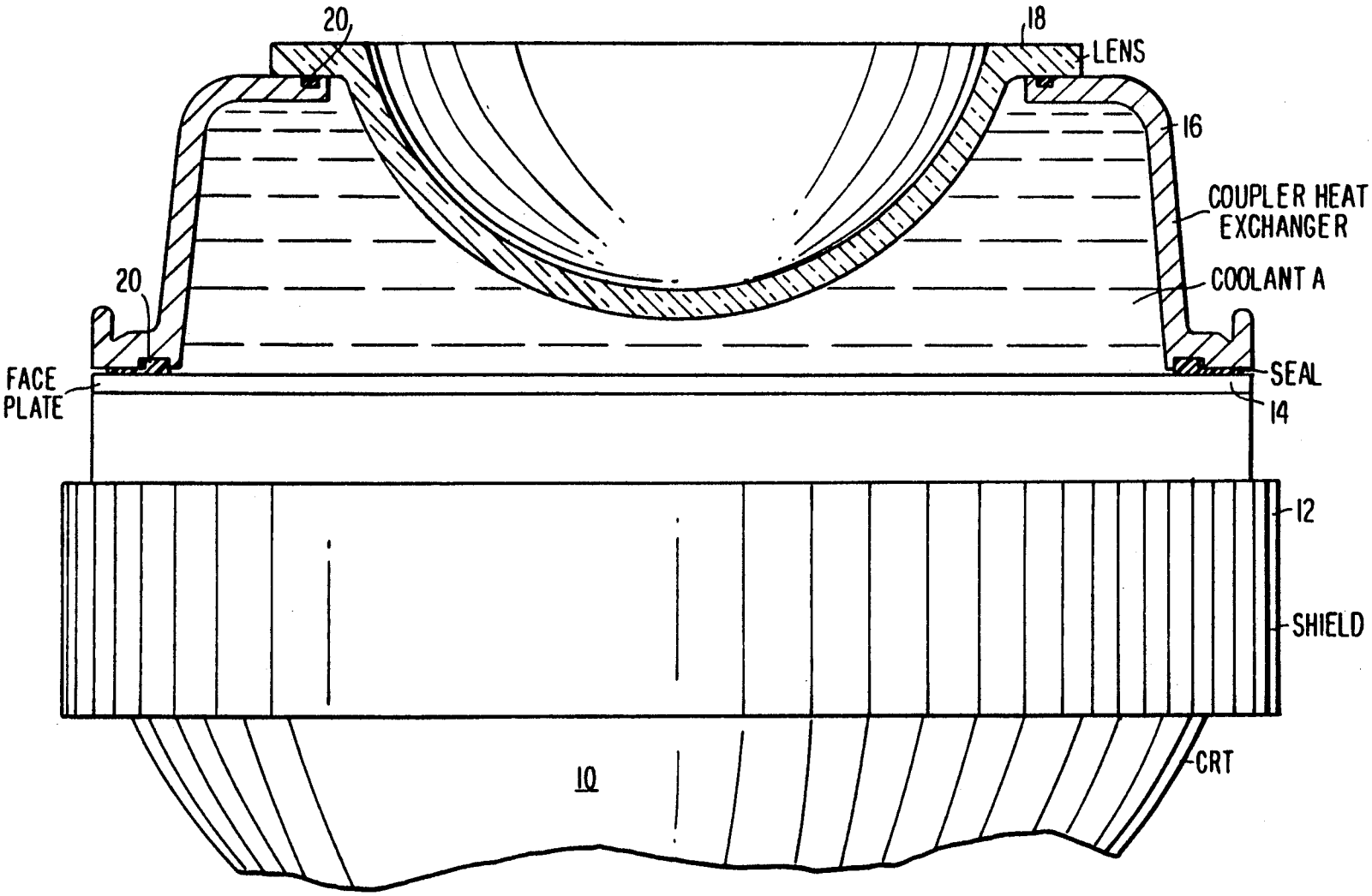
COUPLER HEAT EXCHANGER
COOLANT A
SEAL
14
12
SHIELD
CRT
16
LENS
18
10
20
20
FACE PLATE

OPTICAL GRADE TRANSFER COOLANT FOR PROJECTION TELEVISION RECEIVERS

BACKGROUND OF THE INVENTION

1. Field of the Invention

The subject invention relates to projection television receivers, and more particularly, to cooling liquids for cooling a projection cathode ray tube in the projection television receiver.

In a cathode ray tube, a field of video information is written with the aid of an electron beam on a display screen having a phosphor coating or a pattern of different phosphors. Due to the electron bombardment, the temperature of the phosphor increases so that the light output of the display screen decreases ("thermal quenching"). While this is acceptable in conventional direct-view television receivers, this phenomenon is particularly prevalent in display tubes for projection television receivers in which the display screen is scanned by electron beams having high fluxes. The temperature of the display window increases and brings about a temperature gradient which causes a mechanical stress in the display window. At a high electron beam current and consequently a high thermal load, this may lead to breakage of the display window. To reduce this mechanical stress in the display window due to variations in temperature ("thermal stress") and to obviate the decrease in light output, the display window and the display screen are cooled.

2. Description of the Related Art

U.S. Pat. No. 4,725,755 to Hasegawa, discloses a projection television receiver with a liquid-cooled lens. The projection television receiver includes at least one cathode ray tube for receiving video signals and for projecting images therefrom, having a face, a lens mounted adjacent to the face for focusing the images projected by the cathode ray tube, and a coolant disposed between the lens and the face for absorbing and dissipating heat from the tube. The coolant is particularly specified as being a mixture of glycerol and ethylene glycol including about 20 to 40% by weight of glycerol. This coolant differs from coolants previously used in that glycerol is used instead of water. This substitution reduces the amount of vapor pressure at elevated temperatures. However, it should be noted that ethylene glycol is hygroscopic, i.e. it absorbs water from the atmosphere. Therefore, care must be taken to limit the exposure of the ethylene glycol to moisture. In addition, surfactants should be added to the ethylene glycol/glycerol mixture to reduce the surface tension, along with oxidizers to increase the stability of the mixture.

SUMMARY OF THE INVENTION

It is an object of the present invention to provide a projection television receiver having a coolant for a cathode ray tube therein which is easy to handle.

It is a further object of the present invention to provide a projection television receiver having a coolant for a cathode ray tube therein which is less costly than prior art coolants.

It is still another object of the present invention to provide a projection television receiver having a coolant for a cathode ray tube therein which has only a single component thereby eliminating the need for mixing.

These objects are achieved in a projection television receiver comprising at least one cathode ray tube for receiving video signals and for projecting images therefrom, said tube including a face, lens means mounted adjacent said face for focusing the images projected by said tube, and coolant means between said lens means and said face for absorbing and dissipating heat from said tube, said lens means and said coolant means having substantially the same refractive index for reducing reflections of said images, and wherein said coolant means is a substantially waterless liquid consisting of an isoparaffinic solvent having a high boiling range. A particular isoparaffinic solvent found suitable for the coolant is distributed under the trademark ISOPAR V.

The above objects are also achieved in a method of cooling a cathode ray tube in a projection television receiver having lens means for focusing images formed by said cathode ray tube, said method comprising the steps of providing a cooling chamber between said cathode ray tube and said lens means, said cooling chamber being in contact with a face of said cathode ray tube through which said images are projected, and providing an optically pure substantially waterless liquid consisting of isoparaffinic solvent having a high boiling range as a coolant in said cooling chamber.

BRIEF DESCRIPTION OF THE DRAWING

With the above and additional objects and advantages in mind as will hereinafter appear, the invention will be described with reference to the accompanying drawing, in which the single FIGURE shows a cross-sectional view of a cathode ray tube with a liquid coolant in accordance with the subject invention.

DESCRIPTION OF THE PREFERRED EMBODIMENT

In the FIGURE, a portion of a cathode ray tube 10 for a projection television receiver is shown. A shield 12 is shown surrounding the cathode ray tube 10 for interrupting X-rays. The cathode ray tube 10 includes a face plate 14 through which the images formed on the phosphors are projected. The face plate 14 forms one wall of a cooling chamber therefor which further includes a coupler heat exchanger 16 fastened to the face plate 14 and a lens 18 fastened to an opposite end of the coupler heat exchanger 16 coaxial to the face plate 14. Seals 20 are provided between the face plate 14 and the coupler heat exchanger 16 and between the coupler heat exchanger 16 and the lens 18. A coolant A is introduced in this cooling chamber through a filling port (not shown). In addition, an expansion chamber (not shown) is coupled to the coupler heat exchanger 16 to allow for expansion of the coolant A when heated.

According to the present invention, the coolant A is an isoparaffinic solvent which is distributed by Exxon Corporation under the trademark ISOPAR V. Exxon Product Brochure Lubetext DG-1P, Sep. 21, 1984, contains a description of ISOPAR V and is hereby incorporated by reference. It should be noted that ISOPAR V isoparaffinic solvent may be used within the limitations or is in compliance with U.S. Food and Drug Administration Regulations 21 and 40 for direct food addition, incidental contact with food, used in food processing, in the manufacture of packaging materials that contact food and related uses. ISOPAR V isoparaffinic solvent is a single component substance and has substantially the same index of refraction as the prior art ethylene glycol/glycerol mixture. In addition, ISOPAR V isoparaffinic solvent is non-hygroscopic, exhibits stable oxidation, has a low surface tension and has a higher boiling range (254°-329° C.) than the prior art mixture. Furthermore, ISOPAR V has a substantially lower cost per unit volume than the prior art mixture. In use, ISOPAR V isoparaffinic solvent has demonstrated greater optical clarity and stability than the prior art mixture. ISOPAR V isoparaffinic solvent has also been found to be compatible with aluminum having either an anodized finish or an electro paint deposition process finish which is used for the coupler heat exchanger 16, the acrylic lens system and EPDM rubber which is used for the seals 20.

Numerous alterations of the structure herein disclosed will suggest themselves to those skilled in the art. However, it is to be understood that the present description is for purposes of illustration only and is not intended to be construed as a limitation of the invention. All such modification which do not depart from the spirit of the invention are intended to be included within the scope of the appended claims.

What is claimed is:

1. A projection television receiver comprising at least one cathode ray tube for receiving video signals and for projecting images therefrom, said tube including:

a face;

lens means mounted adjacent said face for focusing the images projected by said tube; and coolant means between said lens means and said face for absorbing and dissipating heat from said tube;

said lens means and said coolant means having substantially the same refractive index for reducing reflections of said images;

wherein said coolant means is an optically clear substantially waterless liquid consisting of an isoparaffinic solvent having a high boiling range.

2. A projection television receiver as claimed in claim 1, wherein said isoparaffinic solvent is ISOPAR V.

3. A method of cooling a cathode ray tube in a projection television receiver having lens means for focusing images formed by said cathode ray tube, said method comprising the steps:

providing a cooling chamber between said cathode ray tube and said lens means, said cooling chamber being in contact with a face of said cathode ray tube through which said images are projected; and providing an optically clear substantially waterless liquid consisting of isoparaffinic solvent having a high boiling range as a coolant in said cooling chamber.

4. A method of cooling a cathode ray tube in a projection television receiver as claimed in claim 3, wherein said isoparaffinic solvent is ISOPAR V.

* * * * *